United States Patent [19]

Standel, Jr.

[11] 4,284,219

[45] Aug. 18, 1981

[54] MULTIPLE CLOTHES HANGERS CARRYING DEVICE

[76] Inventor: Richard R. Standel, Jr., 1177 Race St., (Penthouse 5), Denver, Colo. 80206

[21] Appl. No.: 646,676

[22] Filed: Jan. 5, 1976

[51] Int. Cl.[3] ..... B65D 71/00

[52] U.S. Cl. ..... 294/152; 211/113; 248/215; 248/317; 403/340; 403/393

[58] Field of Search ..... 224/45 T, 45 R, 49, 224/47; 16/110 R; 229/54 R; 211/118, 119, 113; 248/215, 317, 340; 403/339, 340, 393; 294/31.2

[56] References Cited

U.S. PATENT DOCUMENTS

| | | | |
|---|---|---|---|
| 1,175,024 | 3/1916 | Thorson | 224/49 |
| 2,709,005 | 5/1955 | Eckstein | 211/113 |
| 3,119,160 | 1/1964 | Hoppeler | 224/49 X |
| 3,212,647 | 10/1965 | Meyer et al. | 211/118 |
| 3,362,599 | 1/1968 | Galazin | 224/45 P |
| 3,564,590 | 9/1969 | Hebel | 224/45 T |
| 3,584,772 | 6/1971 | Robertson | 224/45 T |
| 3,670,937 | 6/1972 | Bradshaw | 224/45 T |
| 3,692,218 | 9/1972 | Friedman | 224/45 T |
| 3,712,525 | 1/1973 | McFarland | 224/45 T |
| 3,759,430 | 9/1973 | Ward | 224/45 T |
| 3,799,416 | 3/1974 | Schmaltz | 224/45 T |
| 3,912,140 | 10/1975 | Franges | 16/110 R X |

FOREIGN PATENT DOCUMENTS

| | | | |
|---|---|---|---|
| 2019831 | 6/1971 | Fed. Rep. of Germany | 16/110 R |
| 166686 | 1/1934 | Switzerland | 403/339 |
| 137570 | 1/1920 | United Kingdom | 403/339 |

*Primary Examiner*—John P. Silverstrim
*Assistant Examiner*—D. W. Underwood
*Attorney, Agent, or Firm*—Morgan, Finnegan, Pine, Foley & Lee

[57] ABSTRACT

A hanger carrying device for simultaneously carrying multiple clothes hangers upon which garments have been mounted comprising a flexible, support member having hanger-accommodating aperture means for removably fixedly mounting clothes hangers. The carrying device also includes handle means extending from at least one end of the flexible support member, the handle means usually having a generally cylindrical shape adapted to conform to the human hand.

14 Claims, 11 Drawing Figures

MULTIPLE CLOTHES HANGERS CARRYING DEVICE

BACKGROUND OF THE INVENTION

The present invention relates generally to hand carrying devices and more particularly to devices for carrying a plurality of clothes hangers upon which garments or similar items may be mounted.

Wire clothes hangers are widely used for both storing garments in closets and the like and for moving them from place to place with a minimum of wrinkling and folding. The original approach to the problem of carrying such hangers was to simply insert one or more fingers through the hook portion of several hangers and lift them over one's shoulder to minimize the force concentrated on the fingers holding the hangers. However, as the weight of the garments and/or the number of hangers increases, this can become uncomfortable and even quite painful, particularly in the region of the fingers, which generally tend to become tightly pinched together by the hangers. As commercial retail cleaning establishments began increasing in popularity, the occasions calling for the carrying back and forth of multiple garments on clothes hangers became more frequent. Consequently, various attempts have been made to produce a device which would enable a number of such hangers to be carried together conveniently and without the usual discomfort and which would still be economically feasible. One such attempt consisted of a sheet of stiff material with a hole in it through which the carrier's hand could pass. Additional holes were provided to receive a number of clothes hangers. See, for example, U.S. Pat. No. 2,782,974, issued to Borgfeldt. However, this device was comparatively bulky, of rigid construction, not compatible with the automated conveyors now in use in most retail cleaning stores and required complex cutting and folding operations in its manufacture. Another attempt to cope with this problem can be found in U.S. Pat. No. 3,606,967, issued to Roberts. This device consisted of a rectangular handle fixedly connected to a straight support flange member which contained an elongated aperture for accommodating clothes hangers. This device too was bulky and of rigid or semi-rigid construction and its lack of flexibility, particularly in the support flange member, rendered it unadaptable for optimum use on the conveyors used by dry cleaning establishments. In others words, it is apparently impossible to take a number of hangers supporting the clothes of a particular customer which were already mounted on the multiple hanger handle and place them on a clothes conveyor without first removing them from the device because the path of the conveyor has curved portions and the rigid or semi-rigid hanger handle cannot easily bend to conform to the curves. In addition, it would appear from the size and rigidity of the device that it would interfere with the moving parts of the conveyor and conveyor rail mechanism through which the clothes hangers are placed. Thus, the cleaned garments of any one customer could not be segregated on the cleaning establishment's conveyors through the use of the device. The hangers would have to be removed from the conveyors and individually placed into the device while the customer was in the establishment, thus causing unnecessary delay and loss of time to the customer as well as the dry cleaning establishment. Further as a result of the rigid or semi-rigid construction of the straight support flange, there was transmitted to the hand of an individual carrying a number of hangers in an over the shoulder fashion a moment of force equal approximately to the total weight of the clothes being carried times the average distance of the hangers from the shoulder of the carrier. This moment of force, or torque, added significantly to the discomfort and difficulty in carrying numerous garments in this fashion.

Other approaches to the problem recognized the advantages of flexibility over rigidity. However, these attempts resulted in flexible strap type handles having either rigid or flexible hanger support members. The individual would extend his hand through the flexible strap and carry the clothes in an over the shoulder position. However, because the weight of the garments was concentrated on a relatively small area of the individual's hand, these devices did little to reduce the discomfort which resulted as the number and weight of the garments being carried increased. In addition, devices of this type often consisted of several parts which had to be separately manufactured and then assembled, thus rendering the devices relatively expensive and not feasilbe economically.

It is therefore an object of the present invention to provide a new and improved multiple hanger carrying device.

Another object of the invention is to provide a hanger carrying device which will enable one person to easily and comfortably carry a plurality of hangers upon which clothes have been mounted.

Yet another object of the invention is to provide a hanger carrying device which evenly distributes the weight of the garments over a relatively large area of the hand thereby reducing the discomfort normally associated with carrying a plurality of encumbered clothes hangers.

Yet another object of the invention is to provide a hanger carrying device which is capable of one piece construction and economical manufacture.

Another object of the invention is to provide a hanger carrying device which is an inexpensive throw-away item such as one which can be distributed gratuitously by dry cleaning establishments to their customers.

A further object of the invention is to provide a hanger carrying device which is flexible and easily adaptable for use on automatic conveyors commonly used by retail cleaning establishments.

A still further object of the invention is to provide a hanger carrying device which has both a rigid, palm-fitting handle to prevent concentration of the weight on a small area of the fingers and a flexible strap to eliminate the effect of torque forces on the hand and wrist when carrying garments in an over the shoulder manner.

Additional objects and advantages of the invention will become apparent from the detailed description set forth below in light of the accompanying drawings.

SUMMARY OF THE INVENTION

Briefly described, the present invention comprises a flexible elongated support member having a plurality of apertures formed therein through which clothes hangers may be mounted. According to one aspect of the invention, handle means are fixedly attached to both ends of the support member and are of a generally cylindrical shape which will comfortably nestle in the palm of the hand. It has been found that by providing a flexible support member having a plurality of hanger accommodating apertures, the clothes of a particular customer may be grouped together in the device thereby segregating them from the clothes of other customers. Furthermore the flexibility of the support member enables these clothes to be placed as a group on an automated conveyor such as those used by dry cleaning establishments without first removing them from the device.

Additionally, such flexibility eliminates the torque effect which is transmitted to the hand and wrist when carrying a plurality of garments in an over the shoulder fashion on a device with a rigid or semi-rigid support member.

It has also been found that by providing a handle means of a generally cylindrical shape and rigid or semi-rigid construction the weight of the garments is distributed over a large area of the hand thereby eliminating the discomfort normally experienced when carrying a plurality of encumbered clothes hangers.

In another advantageous embodiment, handle means are attached to only one end of the flexible support member, the free end possessing means whereby it may be looped back and releasably attached to the handle means by a hook and eye or similar arrangement.

Additional advantageous embodiments of the invention in view of the objects set forth hereinbefore and hereinafter will become apparent from the following detailed description.

It will be understood that the foregoing general description and the following detailed description as well are exemplary and explanatory of the invention but are not restrictive thereof.

The accompanying drawings, referred to herein and constituting a part hereof, illustrate preferred embodiments of the invention, and together with the description, serve to explain the principles of the invention.

BRIEF DESCRIPTION OF THE DRAWINGS

The present invention is illustrated in the accompanying drawings in which.

DETAILED DESCRIPTION OF PREFERRED EMBODIMENTS

The principal objects and advantages of this invention have been set forth above, but these are by no means all inclusive, and other benefits of the invention will be apparent to those skilled in the art upon consideration of the following detailed disclosure, which refers to the drawings by numerals.

Figure 1:
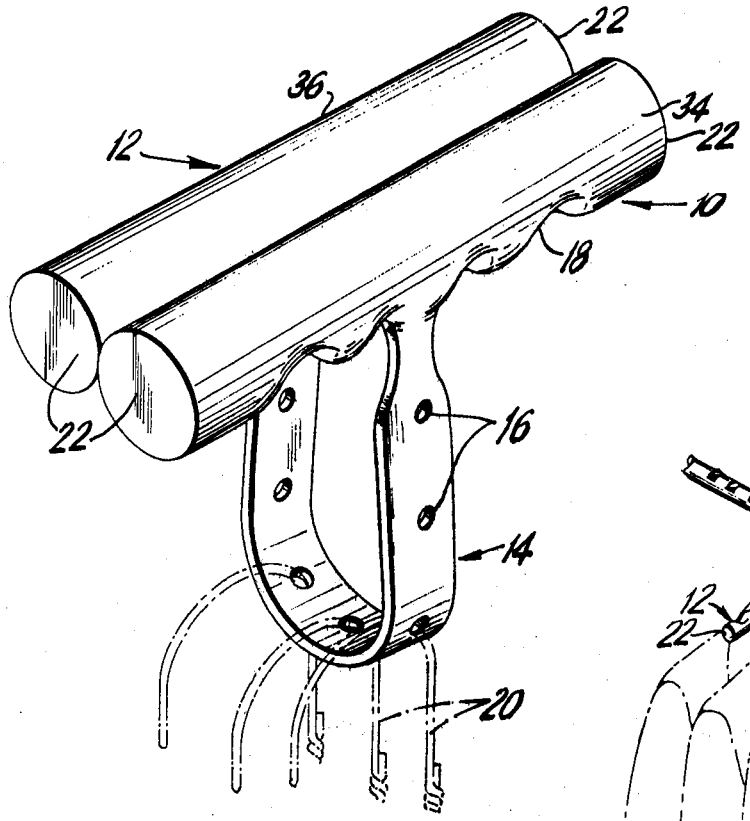
FIG. 1 is a perspect view of one embodiment of the present invention.

Referring to FIG. 1, there is shown a perspective view of a preferred embodiment of the invention as it appears when being used to carry several clothes hangers. According to this embodiment, handle members 10 and 12 are fixedly attached to opposite ends of flexible elongated support member 14. Circular evenly spaced apertures 16 extend through the flexible support member 14, and are of a size suitable for accommodating the hooked part of clothes hangers 20. The handles 10 and 12 have surfaces 34 and 36 respectively, which are of a generally cylindrical shape in order to comfortably fit in the human hand. Advantageously, handles 10 and 12 are formed with a plurality of curved depressions 18 to accommodate the fingers of the person utilizing the invention.

Also advantageously, and as here preferably embodied, handles 10 and 12 and flexible support member 14 are constructed as an integral unit and are made of light inexpensive plastic or other similar compound or of reinforced cardboard or other flexible inexpensive material. In this embodiment the device can be a single use, disposable item. If a plastic material or other compound is chosen the device may be stamped or press formed from a blank, or extruded or molded by conventional molding techniques so as to form a single integral one-piece product. In the event that a reinforced cardboard or similar material is selected the device may be inexpensively formed by rolling the ends of a sheet of the material to form the handle means and then cutting down the center portion to form the flexible support member. Of course it will be understood by those skilled in the art that it is not essential that the device be constructed of one type of material as an integral unit. It would be possible, for example, to construct the device with wooden handles and a paper strap. Advantageously, handles 10 and 12 are sufficiently long to extend the width of the palm and of a diameter which will comfortably fit therein. In a particularly useful embodiment, handles 10 and 12 may be approximately 4 inches in length and up to 1 inch in diameter, having substantially flat, circular surfaces 22 at each end. In addition, flexible elongated support member 14 measures approximately $\frac{3}{4}$ of an inch wide and approximately $\frac{1}{8}$ to $\frac{1}{4}$ of an inch thick depending upon the strength of the specific material employed. However, as preferably embodied, flexible support member 14 should be sufficiently narrow to fit within the curvature of the hanger hook. And although spacing of the hanger accommodating apertures 16 is not critical, they should be spaced at intervals of approximately $\frac{3}{4}$ of an inch. The diameters of the apertures 16 are not critical and may be any size sufficient to accept the type of clothes hangers to be carried. The flexible support member 14 may be made in varying lengths depending upon the number of apertures 16 desired and the spacing of these apertures.

Figure 2:
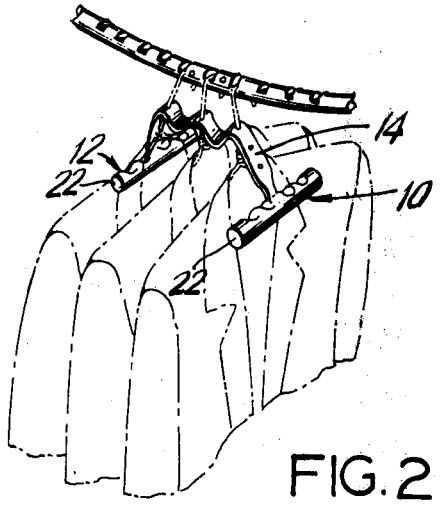
FIG. 2 is a perspective view of the embodiment of FIG. 1 in use.

Referring now to FIG. 2, there is shown a perspective view of the instant invention in use, illustrating its adaptability for use on automated conveyors commonly found in retail cleaning establishments. When the device is in position on the conveyor, the flexibility of support member 14 enables the handles to fall out of the way of the conveyor rail and moving parts and also flexes not only to enable close packing of the hangers but also to conform to the bends and curves in the conveyor path while still serving to handily segregate a particular group of garments from the rest.

Figure 3:
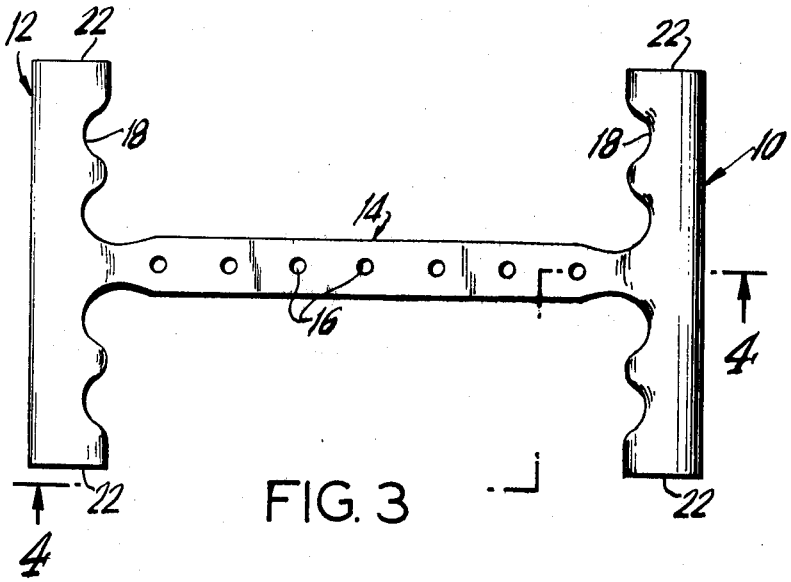
FIG. 3 is a plan view of the embodiment of FIG. 1.

FIG. 3 is a plan view of the embodiment shown in FIG. 1. Clearly visible are curved finger hollows 18 and the position of flexible support member 14 in relation to handles 10 and 12.

Figure 4:
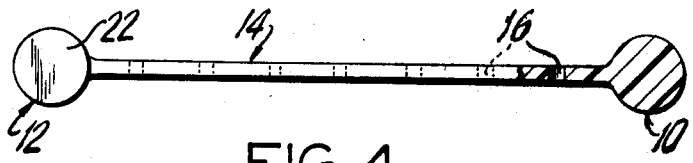
FIG. 4 is a partial sectional view taken along line 4—4 of FIG. 3.

FIG. 4 is a partial sectional elevation view of a preferred embodiment similar to the one shown in FIG. 3 depicting the cross section of the handle 10 approximately at its midpoint and a partial cross section of the flexible support member 14 taken along line 4—4 of FIG. 3 showing apertures 16 extending therethrough.

Figure 5:
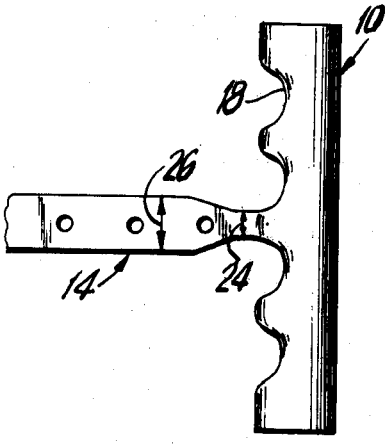
FIG. 5 is a partial plan view similar to FIG. 3 illustrating a tapered flexible support member.

Referring to FIG. 5, the width of flexible support member 14 may advantageously be narrowed at its juncture with handle 10. This embodiment enables flexible support member 14 to be made of a variety of functional widths 26 without causing discomfort to the person using the invention by forcing the fingers on either side of flexible support member 14 apart. The gradual tapering of flexible support member 14 to narrow width 24 enables the user of the device to comfortably grip handles 10 and 12 regardless of the dimension of functional width 26.

Referring generally to FIGS. 6 through 10, there are shown various embodiments of another aspect of the invention. According to this aspect, handles 10 and 12 may be provided with means for maintaining their positions relative to each other. For these Figures, like reference characters refer to like parts and the embodiments illustrated therein are substantially identical to those shown in FIGS. 1 through 5 except as hereinafter described.

Figure 6:
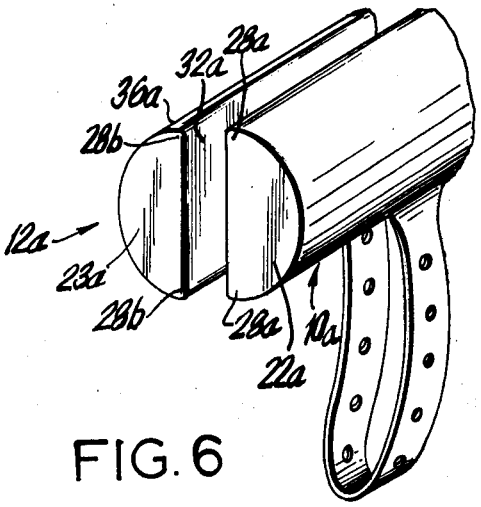
FIGS. 6 through 10 are partial perspective views of alternate embodiments of the present invention.

Referring now to FIG. 6, each handle **10*a* and 12*a*** generally semi-cylindrical such that when placed in contact with each other, as they are in the carrying position, one substantially cylindrical structure is formed.

More particularly, handle **10*a* has a semi-cylindrical curved surface 34*a* and a flat surface 30*a*, the two surfaces being joined together at rounded corners 28*a*. Handle 12*a* also has a semi-cylindrical curved surface 36*a*, a flat surface 32*a* and rounded corners 28*a* adjoining the two surfaces, such that when flat surface 32*a* of handle 12*a* is placed against flat surface 30*a* of handle 10*a* the two handles together form one substantially cylindrical shape. The rounded corners 28*a* prevent pinching as a result of the coming together of handles 10*a* and 12*a*, and designated by reference characters 22*a* and 23*a*** respectively, are complementary semi-circular shapes at the ends of each handle.

Figure 7:
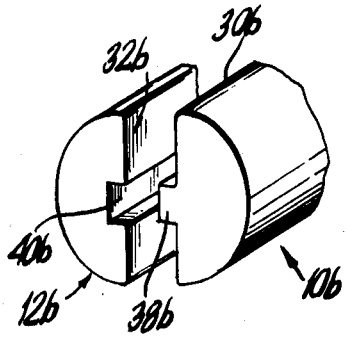

Referring now to FIG. 7, there is shown a particularly useful embodiment wherein handle elements **10*b* and 12*b* may be releasably interlocked when juxtaposed in parallel alignment and brought together as in the carrying position. Thus, their relative positions are secured from both transverse and rotational movement. Handles 10*b* and 12*b* are constructed essentially like handles 10*a* and 12*a* shown in FIG. 6 except that handle 10*b* has a raised notch element 38*b* along the length of flat surface 30*b* and handle 12*b* has a complementary groove 40*b* along the length of flat surface 32*b*. Notch 30*b* is suitably dimensioned to fit easily within groove 40*b* when the handles 10*b* and 12*b*** are brought together.

Figure 8:
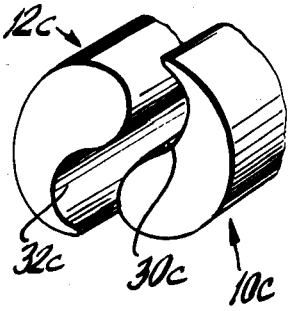

In another advantageous embodiment illustrated in FIG. 8, handles **10*c* and 12*c* are constructed essentially like handles 10*a* and 12*a* shown in FIG. 6 except that surfaces 30*c* and 32*c* of handles 10*c* and 12*c* respectively are complementary S-shaped curvatures which removably contiguously mesh when the handles are juxtaposed in parallel alignment and brought together. The nestling of the surfaces 30*c* and 32*c* when placed in contact with each other necessarily prevents relative rotational as well as transverse movement of the handles 10*c* and 12*c***.

Figure 9:
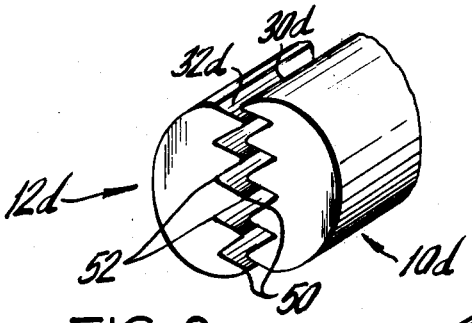

In FIG. 9, yet another advantageous embodiment is shown wherein handles **10*d* and 12*d* are essentially like handles 10*a* and 12*a* shown in FIG. 6 except that surfaces 30*d* and 32*d* of handles 10*d* and 12*d* respectively are constructed with complementary tapered approximately triangular ridges along the length of the handles. When the handles are juxtaposed in parallel alignment and brought together the peaks 50 of one handle interengage the valleys 52** of the other to releasably affix the relative positions of the handles and thereby prevent rotational and transverse movement.

Figure 10:
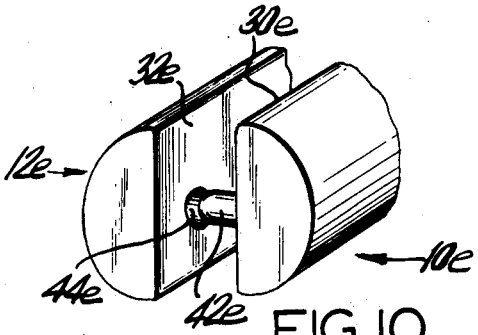

FIG. 10 illustrates a preferred embodiment wherein handles **10*e* and 12*e* are substantially like handles 10*a* and 12*a* shown in FIG. 6 except that surface 30*e* is constructed with at least one dowel 42*e* along its length and surface 32*e* at least one complementarily aligned cavity 44*e*. Cavity or cavities, 44*e* are of a size that will comfortably accommodate dowel or dowels 42*e* when the handles 10*e* and 12*e*** are juxtaposed in parallel alignment and brought together. In this embodiment, the mating of the dowels and cavities will prevent axial as well as rotational and transverse movement of the handles in relation to each other.

Figure 11:
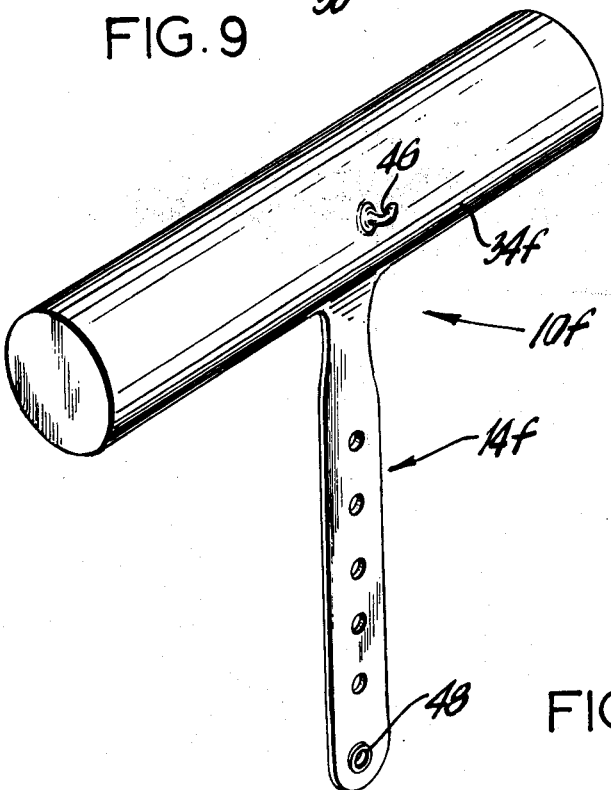
FIG. 11 is a perspective view of an embodiment with handle means fixedly attached to one end of the flexible support member.

Referring now to FIG. 11 there is shown another aspect of the present invention. According to the embodiment illustrated therein, flexible support member **14*f* extends from a single generally cylindrical handle 10*f*. Handle 10*f* is constructed substantially like the handle 10 shown in FIGS. 1 through 5 except that a fastening means 46 protrudes from the surface 34*f*. Flexible member 14*f* is constructed essentially like the member 14 shown in FIGS. 1 through 5 except that only one end of the member is fixedly attached to a handle while the other extends freely. Near the free end of member 14*f* is a reinforced aperture or grommet hole 48 which is designed to removably couple with fastening means 46**.

This embodiment operates in substantially the same manner as the embodiments shown in FIGS. 1 through 10 except that the user of the invention has to manually couple the free end of flexible member **14*f* with fastening means 46** if desired. Such coupling is not essential to the user of this embodiment but may be useful from a standpoint of convenience of carrying as well as for purposes of added strength.

Several typical preferred embodiments of the present invention have been described in detail above and shown in the drawings. However, the present invention is not intended to be limited or restricted to the specific details set forth herein. Other variations and modifications may appear to those skilled in the art which fall within the full intended scope and spirit of the invention as defined in the appended claims.

I claim:

1. A hanger carrying device for simultaneously carrying multiple clothes hangers comprising:

a flexible support member having hanger-accommodating aperture means for removably fixedly mounting at least one clothes hanger, said flexible member being tapered at its ends to a width adapted to comfortably fit between the fingers of the human hand; and handle means fixedly attached to each end of said flexible member, each of said handle means being adapted to conform to a generally semi-cylindrical shape, said handle means further including a plurality of curved depressions to provide a surface for being gripped by the fingers of a hand and interlocking means for preventing relative movement when said handle means are juxtaposed together in parallel alignment.

2. A hanger carrying device both for grouping a plurality of clothes hangers on a garment conveyor device and for enabling the plurality of hangers to be carried by hand when removed from the conveyor device, comprising:

a flexible support member having hanger-accommodating apertures formed therein for removable attachment of clothes hangers; and handle means fixedly attached to each end of said flexible support member, said support member having sufficient flexibility so that, when attached to one or more clothes hangers hanging from the garment conveyor device, said support member rests in a generally horizontal position and the relative positions of the hangers removably attached thereto may be varied in both longitudinal and transverse directions and said handle means rests between the outermost garments of different groups of garments, generally below said flexible support member.

3. The hanger carrying device as claimed in claim 2 wherein said handle means at each end of said flexible support member are formed in a generally semi-cylindrical shape such that when said handle means are placed together in contiguous parallel alignment they form a substantially cylindrical structure.

4. The hanger carrying device as claimed in claim 3 wherein said handle means include means for preventing relative rotational and transverse movement when placed together in alignment.

5. The hanger carrying device as claimed in claim 4 wherein said means for preventing relative rotational and transverse movement comprises a longitudinal projection located along the length of the flat surface of the handle means attached to one end of said flexible member, said projection adapted to releasably interlock with a complementary groove formed along the length of the flat surface of the handle means attached to the other end of said flexible member when the handle means are placed together in contiguous parallel alignment.

6. The hanger carrying device as claimed in claim 4 wherein said means for preventing relative rotational and transverse movement comprises a longitudinal approximately S-shaped surface along the handle means attached to one end of said flexible member, said surface adapted to removably interengage a complementary longitudinal approximately S-shaped surface along the handle means attached to the other end of said flexible member when the handle means are placed in contiguous parallel alignment.

7. The hanger carrying device as claimed in claim 4 wherein said means for preventing rotational and transverse movement comprises a plurality of longitudinal tapered approximately triangular ridges along the handle means attached to one end of said flexible member, said ridges adapted to removably interengage a plurality of complementary longitudinal approximately triangular ridges along the handle means attached to the other end of said flexible member, whereby the peaks of the ridges of one handle means removably interlock with the valleys between the ridges of the other handle means when the handle means are placed together in contiguous parallel alignment.

8. The hanger carrying device as claimed in claim 3 wherein the handle means attached to one end of said flexible member has at least one protruding dowel along its flat longitudinal surface and the handle means on the other end of said flexible member has an equal number of complementary cavities along its flat longitudinal surface, said dowels and cavities being positioned and sized to removably interlock when said handle means are placed together in contiguous parallel alignment whereby relative rotational, transverse and axial movement of the handle means is prevented.

9. A hanger carrying device both for grouping a plurality of clothes hangers on a garment conveyor device and for enabling the plurality of hangers to be carried by hand when removed from the conveyor device, comprising:

a flexible support member having hanger-accomodating apertures formed therein for removable attachment of clothes hangers; and handle means fixedly attached to at least one end of said flexible support member, said handle means comprising a generally cylindrical member adapted to fit comfortably in a partially closed hand; said support member being tapered at its juncture with said cylindrical member to provide a portion of reduced width in said support member for positioning between the fingers of a hand gripping said cylindrical member, and said support member having sufficient flexibility so that, when attached to one or more clothes hangers hanging from the garment conveyor device, said support member rests in a generally horizontal position and the relative positions of the hangers removably attached thereto may be varied in both longitudinal and transverse directions and said handle means rests between the outermost garments of different groups of garments, generally below said flexible support member.

10. A hanger carrying device according to claim 9 which includes a said cylindrical member fixedly attached to each end of said support member.

11. A hanger carrying device both for grouping a plurality of clothes hangers on a garment conveyor device and for enabling the plurality of hangers to be carried by hand when removed from the conveyor device, comprising:

a flexible support member having hanger-accommodating apertures formed therein for removable attachment of clothes hangers;

handle means fixedly attached to one end of said flexible support member; and means for releasably attaching the other end of said support member to said handle means, said support member having sufficient flexibility so that, when attached to one or more clothes hangers hanging from the garment conveyor device, said support member rests in a generally horizontal position and the relative positions of the hangers removably attached thereto may be varied in both longitudinal and transverse directions and said handle means rests between the outermost garments of different groups of garments, generally below said flexible support member.

12. A hanger carrying device according to claim 11 wherein said attaching means includes engaging means formed on said handle means and an aperture formed in said support member, generally near its said other end adapted to be releasably attached to said engaging means.

13. A hanger carrying device according to claim 11 wherein said support member is tapered at its juncture with said handle means to provide a portion of reduced width in said support member for positioning between the fingers of a hand gripping said handle means.

14. A hanger carrying device according to claim 3 wherein said support member is tapered at its juncture with each said handle means to provide a portion of reduced width in said support member for positioning between the fingers of a hand gripping said handle means when placed together in alignment.

* * * * *